US005980129A

United States Patent [19]

Yale

[11] Patent Number: 5,980,129

[45] Date of Patent: Nov. 9, 1999

[54] APPARATUS FOR CLEANING AN X-RAY DEVELOPING MACHINE

[76] Inventor: Joyce K. Yale, 428 31st St., Hermosa Beach, Calif. 90254

[21] Appl. No.: 09/050,497

[22] Filed: Mar. 30, 1998

[51] Int. Cl.[6] ..... G03D 3/08

[52] U.S. Cl. ..... 396/619

[58] Field of Search ..... 396/619, 626, 396/646, 647, 622, 617; 355/27–29

[56] References Cited

U.S. PATENT DOCUMENTS 3,882,525 5/1975 Zwettler ..... 396/622

4,125,852 11/1978 Brooks ..... 396/647

*Primary Examiner*—D. Rutledge

*Attorney, Agent, or Firm*—Hugh P. Gortler

[57] ABSTRACT

Disclosed herein is an apparatus for cleaning residue from a transport unit of an x-ray developing machine. The transport unit has inner and outer walls which form a path for multiple film chips to travel during development of the film chips. V-grooves in the walls can become clogged with residue during normal operation of the x-ray developing machine. The apparatus includes a body and a plurality of projections extending outward from the body. The projections clear the V-grooves of residue while the apparatus is inserted between the walls and moved along the path.

15 Claims, 2 Drawing Sheets

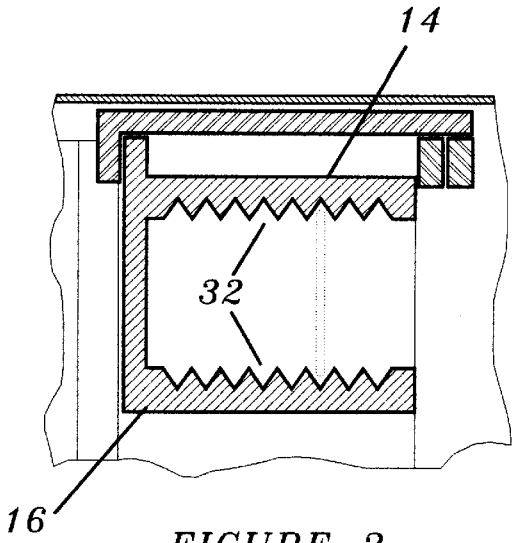
FIGURE 2
FIGURE 3
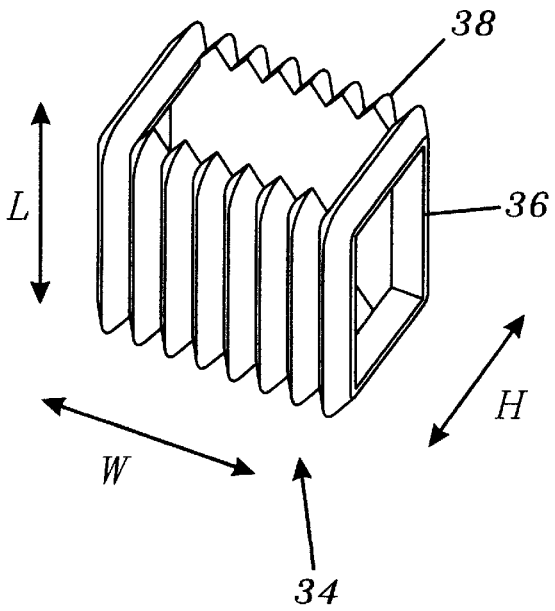
FIGURE 4
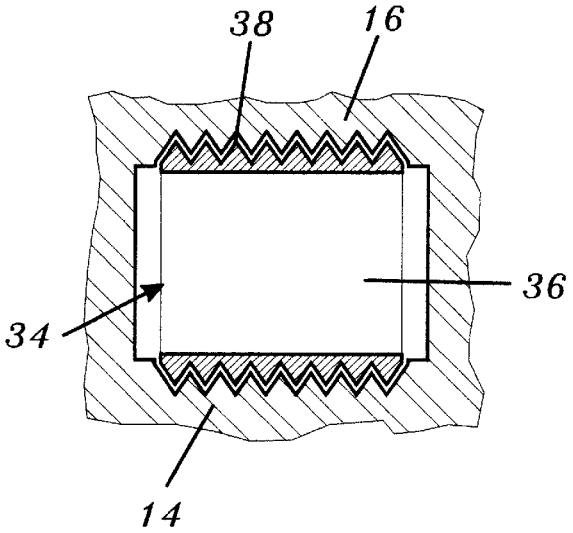

APPARATUS FOR CLEANING AN X-RAY DEVELOPING MACHINE

BACKGROUND OF THE INVENTION

The invention relates to x-ray developing machines. More specifically, the invention relates to the cleaning of x-ray developing machines.

X-ray developing machines are widely used in dental offices. An x-ray developing machine can develop as many as eight film chips simultaneously and quickly, typically in about four to six minutes. Such speed allows a dentist to provide a quick diagnosis and immediate care to a patient. Additionally, the x-ray developing machine take up little office space. A space as small as a closet can be used as a darkroom for developing the film chips.

FIG. 1 shows an x-ray developing machine 10 that is commonly used in dental offices for developing film chips. The x-ray developing machine 10 includes a transport unit 12 having inner and outer walls 14 and 16 that provide a curved path for the film chips to travel. One or more film chips are inserted through an entrance passageway 18 and into the transport unit 12. Each film chip is moved along the path by a combination of gravity (during downward travel) and transfer drives 20 (during upward travel). During its travel along the path, the film chip is immersed in a first tank 22 filled with developer solution, a second tank 24 filled with a fixing solution, and a third tank 26 filled with a rinsing solution. After leaving the transport unit 12, the film chip enters a drying compartment 28 and passes through a series of rollers 30. Exiting the x-ray developing machine 10 is fully developed film.

FIG. 2 shows V-grooves 32 in the walls 14 and 16 of the transport unit 12. A function of the V-grooves 32 is to guide the film chips along the path, yet to minimize contact with the walls 14 and 16 so as not to damage the emulsion on the surfaces of the film chips.

However, with each film chip that passes through the transport unit 12, residue from solution accumulates in the V-grooves 32. The residue can cause the film chips to become jammed in the transport unit 12 or hop off the path and fall into one of the tanks 22, 24 or 26. If a film chip becomes jammed or falls off the path, it will become crumbled, overdeveloped or otherwise ruined. Consequently, x-rays will have to be retaken at great expense to the patient, who will be exposed to additional radiation, and to the dentist or x-ray technician, who will have time taken away from his or her routine. To avoid these problems, the transport unit 12 is cleaned of the accumulated residue on a daily basis.

Cleaning the transport unit 12 can be messy and cumbersome. The transport unit 12 is removed from its housing and held over the tanks 22, 24 and 26 for a few seconds in order to allow excess solution to be drained. Care must be taken not to splash the solution; otherwise chemistry contamination might result. Additionally, the solution might drip on the floor or clothing, the latter of which would be stained permanently. After being drained, the transport unit 12 is placed on a service tray and carried over to a large sink. The transport unit 12 is rinsed in warm soapy water and hand-brushed to remove the dried residue. Once dried, the transport unit 12 is reinstalled in the housing of the x-ray developing machine 10.

There is a need for a less cumbersome, less messy way of removing residue from the transport unit 12 of an x-ray developing machine.

SUMMARY OF THE INVENTION

A transport unit having first and second walls that define a film chip path and that include a plurality of V-grooves can be cleaned conveniently, quickly and cleanly by the present invention. The present invention can be regarded as an apparatus including a body and a plurality of projections extending outward from the body. The projections match the V-grooves in dimension and contour such that the projections engage at least some of the V-grooves when the apparatus is inserted between the walls. The projections clear the V-grooves of residue while the apparatus is inserted between the walls and moved along the path. Because the apparatus can clean residue from the x-ray developing machine conveniently, quickly and cleanly, it encourages frequent cleaning, which improves the reliability of the x-ray developing machine.

BRIEF DESCRIPTION OF THE DRAWINGS

FIG. 2 is a cross-sectional view of a transport unit, which forms a part of the x-ray developing machine;

FIG. 3 is a perspective view of a cleaning cartridge according to the present invention; and FIG. 4 is a cross-sectional view of the cleaning cartridge inserted in the transport unit.

DETAILED DESCRIPTION OF THE PREFERRED EMBODIMENTS

Figure 1:
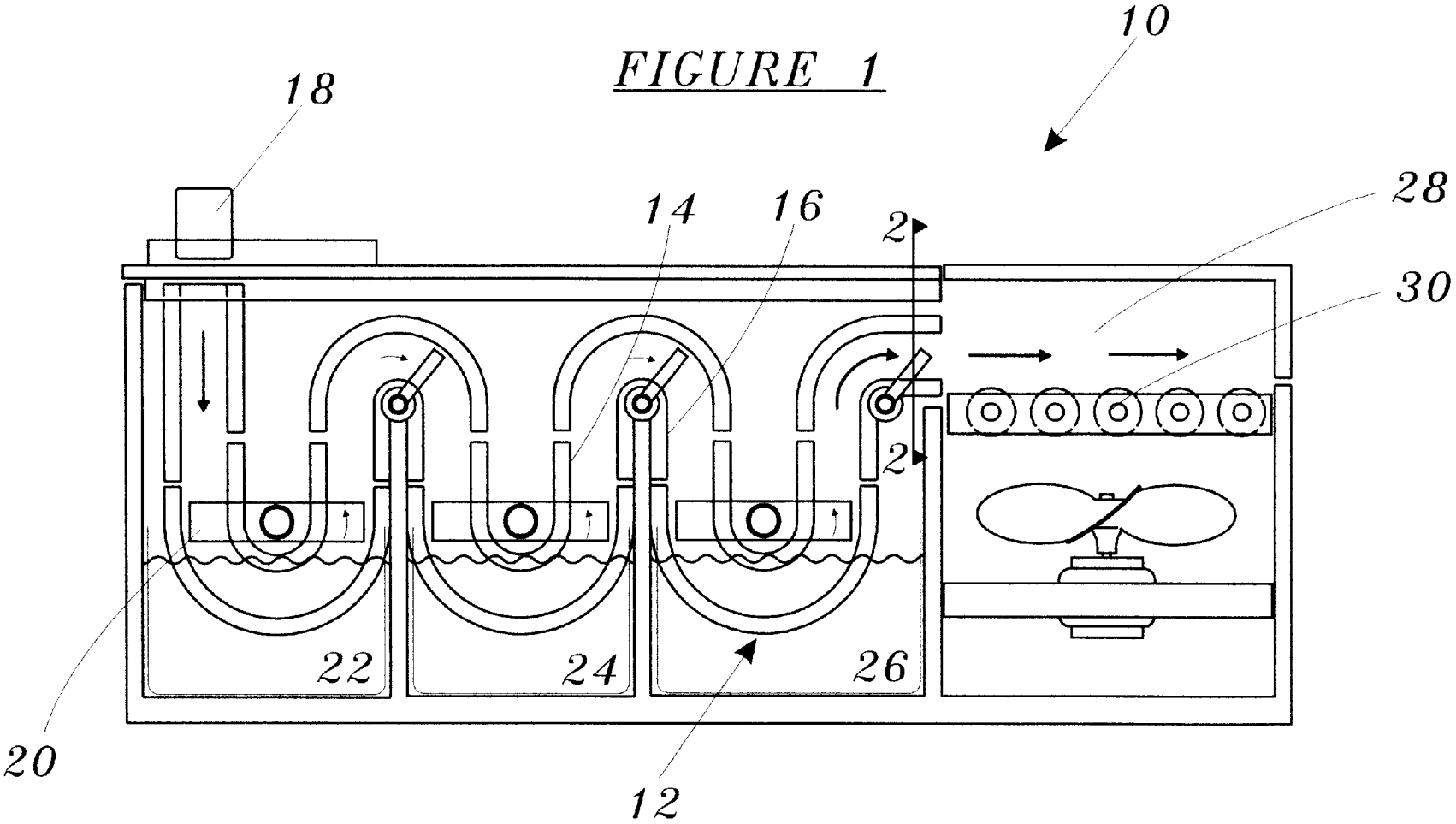
FIG. 1 is an illustration of an x-ray developing machine.

FIG. 3 shows a cleaning cartridge 34 for cleaning residue from the transport unit 12 of the x-ray developing machine 10 described above in connection with FIGS. 1 and 2. One such x-ray developing machine 10 is described in detail in U.S. Pat. No. 3,882,525.

The cleaning cartridge 34 includes a body 36 and a plurality of projections 38 extending outward from the body 36. The body 36 has a height H and width W equal to the height and width of a standard film chip for the transport unit 12. A standard #2 x-ray film chip has a height H of approximately 1 and 19/32 inches and a width W of approximately 1 and 1/8 inches.

The projections 38 match the V-grooves in dimension and contour such that the projections 38 engage at least some of the V-grooves 32 when the cleaning cartridge 34 is inserted into the transport unit 12, between the inner and outer walls 14 and 16 (see FIG. 4). The cleaning cartridge 34 is moved along the film path during a cleaning operation in the same manner that multiple film chips would be moved simultaneously along the film path during development. As the cleaning cartridge 34 is moved along the film path, the projections 38 engage the V-grooves 32 and clear the V-grooves 32 of residue. The residue crumbles into harmless powder and is pushed aside.

Length L of the cleaning cartridge 34 is determined by the number of projections 38. The cleaning cartridge 34 can have a number of projections 38 that engage all of the V-grooves 32 in the walls 14 and 16. Each projection 38 could circumscribe the body 36 to fit into a V-groove 32 on the inner wall 14 and a V-groove 32 in the outer wall 16.

For a typical x-ray developing machine 10 that accepts up to eight #2 x-ray film chips, the cleaning cartridge 34 has eight projections 38 circumscribing the body 36. Overall length L is approximately 2 and 5/16 inches, overall height H is approximately 1 and 11/16 inches, and overall width W is approximately 1 and 2/16 inches.

Not all of the V-grooves 32 need to be engaged during a cleaning operation. Therefore, the cleaning cartridge 34 for the typical x-ray developing machine 10 could have fewer that eight projections 38 circumscribing the body 36.

To clean residue from the transport unit 12, a lid of the entrance passageway 18 of the x-ray developing machine 10 is lifted, and the cleaning cartridge 34 is inserted through the entrance passageway 18 and into the transport unit 12 such that the projections 38 engage the V-grooves 32. The x-ray developing machine 10 is turned on, whereby the cleaning cartridge 34 is moved along the film path by a combination of gravity (during downward travel) and transfer drives 20 (during upward travel). During its travel along the path, the cleaning cartridge 34 is immersed in the first tank 22, the second tank 24 and the third tank 26. After leaving the transport unit 12, the cleaning cartridge 34 enters the drying compartment 28, passes through the rollers 30 and exits the x-ray developing machine 10.

The body 36 can be made hollow, which would allow for flexibility as the cleaning cartridge 34 travels along the film path. The body 36 and the projections 38 can be integrally formed from molded plastic.

The body 36 and the projections 38 can be made of a heat-retaining material, whereby the cleaning cartridge 34 is heated prior to insertion into the x-ray developing machine 10. Heating the cleaning cartridge 34 could help remove residue.

Thus disclosed is a cleaning cartridge 34 that can clean residue from an x-ray developing machine conveniently, quickly and cleanly. The cleaning cartridge 34 can eliminate chemistry contamination and staining due to splashing and dripping. The ease of use encourages frequent cleaning, which improves the reliability of the x-ray developing machine.

A specific embodiment of the invention have been described and illustrated above. However, the invention is not limited to the specific form so described and illustrated. Instead, the invention is construed according to the claims that follow.

I claim:

1. Apparatus for cleaning an x-ray developing machine, the machine including a transport unit having first and second walls, the first and second walls including a plurality of V-grooves, the walls forming a film chip path, the apparatus comprising:

a body; and a plurality of projections extending outward from the body, the projections matching the V-grooves in dimension and contour, the projections engaging at least some of the V-grooves when the apparatus is inserted between the walls, whereby the apparatus can clear the V-grooves of residue while the apparatus is inserted between the walls and moved along the path.

2. The apparatus of claim 1, wherein body has a width and height of a #2 film chip.

3. The apparatus of claim 1, wherein the body is hollow.

4. The apparatus of claim 1, wherein the projections engage all of the V-grooves when the apparatus is inserted between the walls.

5. The apparatus of claim 1, wherein each projection circumscribes the body to fit into a V-groove on the first wall and a V-groove in the second wall.

6. The apparatus of claim 1, wherein the body and the projections are made of a heat-retaining material, whereby the apparatus can be heated prior to insertion in the machine to help remove residue.

7. The apparatus of claim 1, wherein the body and the projections are sized for a dental x-ray developing machine.

8. A cleaning cartridge for an x-ray developing machine, the machine including a transport unit having first and second walls, the first and second walls including a plurality of V-grooves, the walls forming a film chip path, the cleaning cartridge comprising:

a body having a width and height of a #2 film chip; and a plurality of projections extending outward from the body, the projections matching the V-grooves in dimension and contour, the projections engaging at least some of the V-grooves when the apparatus is inserted between the walls.

9. The cleaning cartridge of claim 8, wherein the projections engage all of the V-grooves when the cleaning cartridge is inserted between the walls.

10. The cleaning cartridge of claim 8, wherein each projection circumscribes the body to fit into a V-groove on the first wall and a V-groove in the second wall.

11. The cleaning cartridge of claim 8, wherein the body is hollow.

12. The cleaning cartridge of claim 8, wherein the body and the projections are made of a heat-retaining material, whereby the cleaning cartridge can be heated prior to insertion in the machine to help remove residue.

13. A cleaning cartridge for a dental x-ray developing machine, the machine including a transport unit having first and second walls, the first and second walls including a plurality of V-grooves, the walls forming a film chip path, the cleaning cartridge comprising:

a hollow body having a width and height of a #2 film chip; and a plurality of projections circumscribing the body, the projections matching the V-grooves in dimension and contour such that each projection fits into a V-groove in the first wall and a V-groove in the second wall when the apparatus is inserted between the walls.

14. The cleaning cartridge of claim 13, wherein the projections engage all of the V-grooves when the cleaning cartridge is inserted between the walls.

15. The cleaning cartridge of claim 13, wherein the body and the projections are made of a heat-retaining material, whereby the cleaning cartridge can be heated prior to insertion in the machine to help remove residue.

* * * * *